United States Patent [19]

Jason et al.

[11] Patent Number: 4,653,824

[45] Date of Patent: Mar. 31, 1987

[54] LOCK-OUT DEVICE FOR ELECTRICAL APPLIANCES

[76] Inventors: Phillipp Jason, 8106 Encino Ave., Northridge; Mark H. Jacobson, 13026 Calvert St., Van Nuys, both of Calif. 91401

[21] Appl. No.: 837,738

[22] Filed: Mar. 10, 1986

[51] Int. Cl.[4] ..... H01R 13/44

[52] U.S. Cl. ..... 339/37; 339/36

[58] Field of Search ..... 339/36, 37, 82

[56] References Cited

U.S. PATENT DOCUMENTS 2,955,272 10/1960 Gallardo ..... 339/37

3,345,600 10/1967 Scherer ..... 339/37

FOREIGN PATENT DOCUMENTS 509276 11/1928 Fed. Rep. of Germany ..... 339/37

1354173 1/1964 France ..... 339/37

*Primary Examiner*—Gil Weidenfeld

*Assistant Examiner*—Paula A. Austin

*Attorney, Agent, or Firm*—Kelly, Bauersfeld & Lowry

[57] ABSTRACT

A lock-out device is provided for preventing unauthorized use of an electrical appliance such as a television, power tool, or the like. The lock-out device comprises an open-ended housing for receiving the electrical plug of an electrical appliance. A lock member is carried by the housing generally at or near the entrance end thereof to prevent unauthorized removal of the plug from the housing, thereby preventing unauthorized use of the appliance.

8 Claims, 7 Drawing Figures

FIG. 1
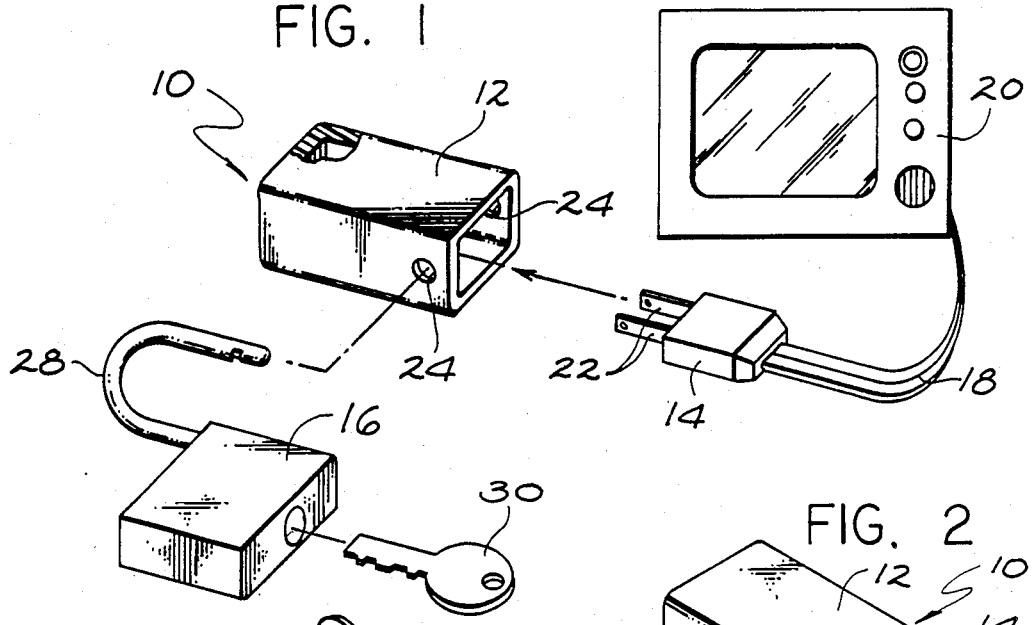
FIG. 2
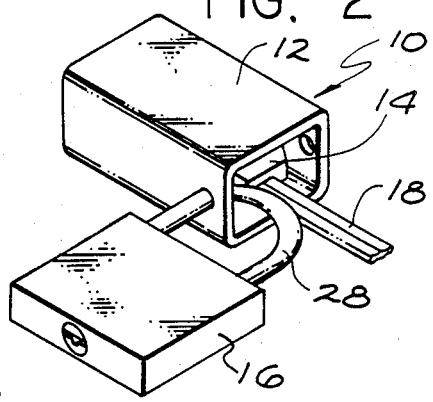
FIG. 3
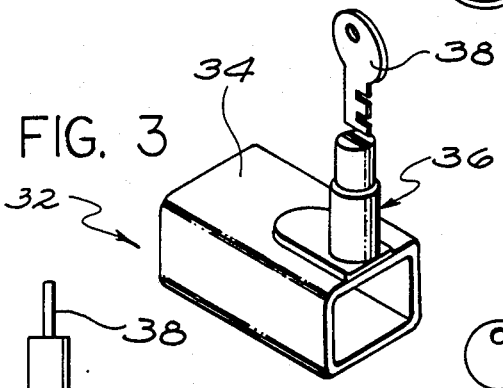
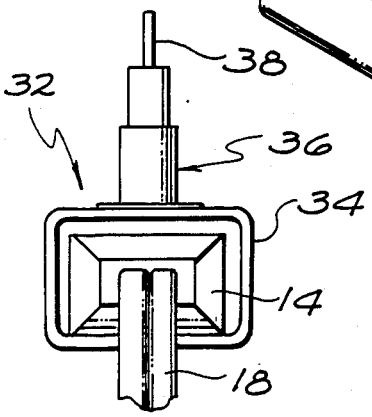
FIG. 4
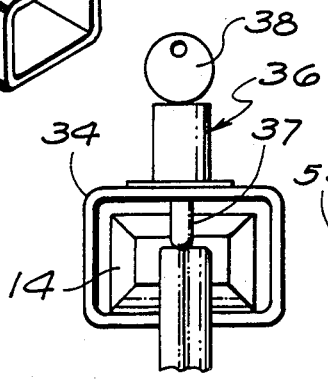
FIG. 5
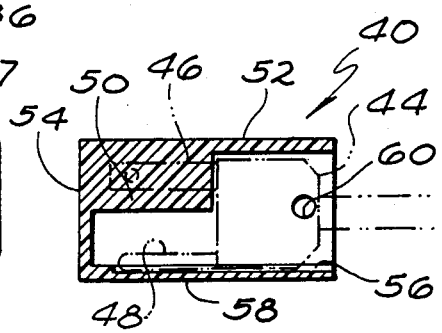
FIG. 7
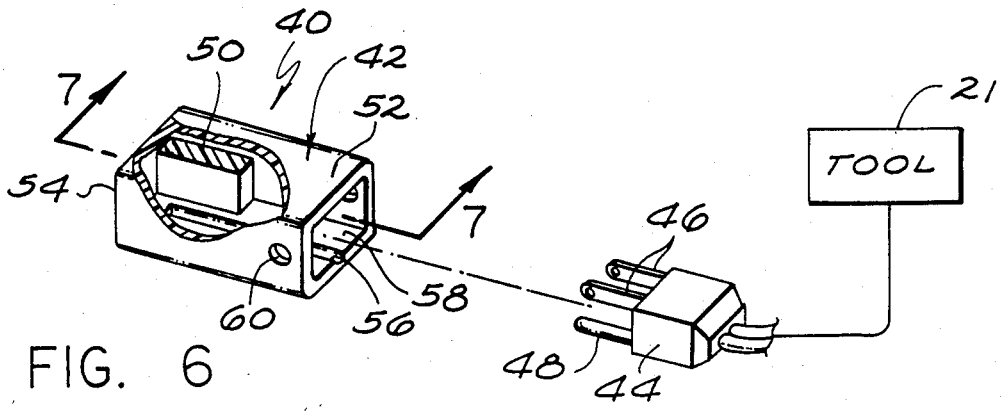
FIG. 6

LOCK-OUT DEVICE FOR ELECTRICAL APPLIANCES

BACKGROUND OF THE INVENTION

This invention relates generally to apparatus for controlling use of electrical appliances, such as televisions, power tools, and other electrical devices. More particularly, this invention relates to a relatively simple and easy-to-use device for positively preventing use of the appliance on a temporary basis.

Modern homes and businesses include a wide variety of electrical appliances designed for wide range of recreational and utilitarian functions. Such electrical appliances commonly include a power cord having a plug to fit within a standard electrical receptacle, thereby connecting the appliance to a source of electrical power to permit appliance operation. However, in many instances it is desirable to prevent appliance operation, for example, by children in the absence of adult supervision or by unskilled persons in the absence of appropriate supervision.

By way of specific example, for many parents, it is desirable to prevent children from viewing television for excessive time periods, or in lieu of doing schoolwork or other more beneficial activities. In addition, it is frequently desirable to prevent children from watching television programs or video cassette recorded programs intended for adult viewing. However, at present, there exists no simple and economic means for temporarily disabling an appliance such as a television yet permit easy reactivation of the appliance for use.

Similarly, it is frequently desirable to prevent unauthorized use of many other types of electrical appliances, for example, traditional home workshop tools such as power saws, power drills, and the like. In this way, accidents occurring during use by children or other unskilled persons can be avoided. However, there presently does not exist a simple and effective device for temporary disablement of such appliances.

There exists, therefore, a significant need for a relatively simple, economical, and easy-to-use device for temporarily preventing unauthorized use of electrical appliances such as televisions, workshop tools, and the like. The present invention fulfills this need and provides further related advantages.

SUMMARY OF THE INVENTION

In accordance with the invention, a relatively simple and easy-to-use lock-out device is provided for preventing unauthorized use of a wide range of electrical appliances of the type having an electrical plug at the end of a power cord. The device comprises a lightweight, open-ended housing for receiving the plug, in combination with means for releasable locking of the plug into the housing, thereby preventing unauthorized use of the appliance.

In the preferred form of the invention, The open-ended housing is formed from lightweight molded plastic or the like to have a generally rectangular cross section shaped and sized for relatively close reception of the electrical plug. The housing includes at least one opening in one side wall thereof near the open housing end for receiving the shackle of a padlock or other lock device. When the shackle is received through the housing opening, the shackle obstructs plug removal from the housing, thereby preventing appliance use.

In one alternative form, the housing supports a lock unit mounted thereon. The lock unit includes a key operated lock pin for advancement into the housing near the open end thereof when the electrical plug is received into the housing to prevent plug removal and use of the appliance. In another form, the housing defines an internal groove for receiving the grounding prong of a conventional three prong plug, together with a short divider wall which fits between the conventional pair of primary circuit prongs of the plug to prevent plug twisting within the housing, wherein such twisting could otherwise encourage attempts to remove the plug from the housing.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is an exploded perspective view illustrating a lock-out device embodying the novel features of the invention;

FIG. 2 is a perspective view of the lock-out device depicted in a locked position;

FIG. 3 is a perspective view depicting one alternative form of the invention in an open position;

FIG. 4 is an end elevation view of the embodiment of FIG. 3;

FIG. 5 is an end elevation view of the embodiment of FIG. 3 in a locked position;

FIG. 6 is a fragmented exploded perspective view of a further alternative form of the invention; and FIG. 7 is a vertical sectional view taken generally along the line 7—7 of FIG. 6.

DETAILED DESCRIPTION OF THE PREFERRED EMBODIMENTS

As shown in the exemplary drawings, a lock-out device referred to by the reference numeral 10 is provided for preventing unauthorized or undesired use of an electrical appliance. The lock-out device 10 comprises a relatively simple and lightweight housing 12 for reception of the electrical plug 14 of the appliance, in combination with a lock member 16 for releasably locking the plug 14 into the housing to prevent appliance use.

The lock-out device 10 of the present invention provides an economical and easy-to-use device for positively preventing unauthorized use of many different types of electrical products. For example, as illustrated in FIG. 1 of the drawings. the device can be used to receive the electrical plug 14 on the end of the power cord 18 for a television 20, thereby preventing unauthorized television use by children or by others in the absence of appropriate supervision. Alternately, as viewed in FIG. 6, the device can be used with other types of electrical products such as workshop power tools 21 including saws, drills, and the like to prevent accidents.

As shown in FIGS. 1 and 2, the lock-out device 10 comprises the housing 12 which may be formed from a lightweight molded plastic or the like to have an open-ended configuration with a generally rectangular cross section. The cross section of the housing 12 is chosen to accept the plug 14 in relatively close sliding relation with the conventional pair of metal circuit prongs 22 projecting into the housing. Importantly, the length of the housing interior is selected to fully receive the plug 14 beyond an opening 24 formed in one side wall of the housing near the open end thereof, with two of said openings 24 in opposite side walls of the housing being depicted in the drawings by way of example.

With the electrical plug 14 seated within the housing 12, the lock member 16 can be secured through one or both of the openings 24 to obstruct withdrawal of the plug 14, thereby preventing normal insertion of the plug into an electrical socket (not shown) to correspondingly prevent appliance operation. More specifically, in the illustrative embodiment, the lock member 16 comprises a padlock having a U-shaped shackle 28 sized for reception through one of the openings 24. The shackle 28 is then locked in place by the padlock 16 to prevent plug withdrawal and appliance use until the padlock is unlocked by a key 30 to permit plug withdrawal.

The lock-out device 10 provides an extremely simple yet highly effective device for use, for example, in preventing unauthorized use of the television 20 or the like. In particular, when the plug 14 is locked into the housing 12, the television cannot be operated thereby preventing children from viewing programs intended for adults or when other activities are desired such as performance of schoolwork and the like.

One alternative form of the invention is shown is FIGS. 3–5, wherein a modified lock-out device 32 comprises an open-ended housing 34 which again may be formed from a lightweight molded plastic or the like. In this version of the invention, the cross sectional shape of the housing 34 is again chosen to receive the plug 14 of an electrical appliance in close sliding relation. However, in lieu of the opposed openings 24 (FIGS. 1 and 2) in the housing side walls, a pin lock unit 36 is mounted directly on the housing 34 and includes a lock pin 37 (FIG. 5) which can be advanced into or retracted from the housing interior by operation of the lock unit 36 with a key 38. More specifically, when the appliance plug 14 is received into the housing 34, the lock unit 36 can be operated by the key 38 to advance the lock pin 37 partially into the housing, as viewed in FIG. 5, thereby obstructing and preventing removal of the plug.

Another alternative form of the invention is shown in FIGS. 6 and 7. In this form, a further modified lock device 40 includes an open-ended housing 42 of molded plastic or the like and adapted for relatively close sliding reception of a three prong electrical plug 44 of the type having a pair of primary circuit prongs 46 and a third grounding prong 48. Such three prong plugs 44 are commonly used with many appliances, such as the schematically depicted power tool 21, for example, power drills, saws, and the like.

The modified housing 42 includes a central divider wall 50 depending from a top wall 52 of the housing and extending a short distance from a housing rear wall 54 generally to a midway point within the housing 42. This divider wall 50 has an overall length and width for receiving the plug circuit prongs 46 on opposite sides thereof when the plug is slidably received into the housing. The divider wall 50 cooperates with a recessed longitudinal channel or groove 56 in the housing lower wall 58, wherein the groove slidably receives the grounding prong 48, to prevent plug twisting or rotation within the housing. Side wall openings in the housing 42 may receive the shackle of a padlock or the like (FIG. 1) to lock the plug within the housing, or, in the alternative, a pin lock unit of the type shown in FIG. 3 can be mounted on the housing 42 to lock the plug in place.

The electrical plug lock-out device of the present invention thus provides a simple, economical, and easy-to-use apparatus for temporarily preventing unauthorized use of an appliance. The device is installed rapidly when desired and without the use of tools to positively lock the electrical plug of an appliance against use, and rapidly removed when desired to free the plug for normal appliance use.

A variety of further modifications and improvements to the invention described herein are believed to be apparent to those skilled in the art. Accordingly, no limitation on the invention is intended by way of the description and drawings except as set forth in the appended claims.

What is claimed is:

1. A lock-out device for preventing use of an electrical appliance having a power cord with an electrical plug at the end thereof, said device comprising:

a housing having an open end for relatively close sliding reception of the appliance plug, said housing further including an internal central divider wall extending a short distance from a rear wall of said housing opposite said open end and terminating in spaced relation with said open end, said divider being sized to receive the primary circuit prongs of the plug on opposite sides thereof to prevent twisting of the plug within the housing, and an internal groove formed to extend along a bottom wall of said housing, said divider wall extending generally along a top wall of said housing, said groove being for receiving the grounding prong of a three prong plug; and lock means for engagement with said housing generally at the open end thereof subsequent to reception of the appliance plug therein, said lock means obstructing removal of the plug from said housing.

2. The lock-out device of claim 1 wherein said housing is formed from a lightweight molded plastic.

3. The lock-out device of claim 1 wherein said lock member comprises a pin lock unit mounted on said housing, said pin lock unit including a lock pin for selected advancement at least partially into said housing and for retraction from said housing, said lock pin obstructing removal of the plug from said housing when advanced into said housing.

4. The lock-out device of claim 1 wherein said housing has at least one opening formed in a side wall thereof near the open end thereof, and wherein said lock means comprises a padlock having a shackle for locked reception through said opening to obstruct plug removal from said housing.

5. The lock-out device of claim 4 wherein said housing has a pair of said openings formed therein in opposite side walls thereof, the shackle of said padlock being receivable through a selected one of said openings.

6. A lock-out device for preventing normal insertion of the electrical plug of an electrical appliance into a power receptacle, said device comprising:

an open-ended housing having a cross sectional shape for relatively close sliding reception of the plug with the primary circuit prongs thereof extending into the housing, said housing further having at least one opening formed therein near the open end thereof; and a lock member including a pin lock unit having a lock pin for extending through said at least one opening when the plug is received into the housing, said lock pin being lockingly received through said at least one opening and obstructing removal of the plug from said housing.

7. The lock-out device of claim 6 wherein said housing further includes a central divider wall extending a short distance from a rear wall of said housing opposite said open end and terminating short of said at least one opening, and a longitudinal groove formed on the inboard side of a bottom wall of said housing, said divider wall extending along a top wall of said housing, said divider wall being sized for receiving the primary circuit prongs of the plug on opposite sides thereof, and said groove being sized for sliding reception of the grounding prong of a three prong plug.

8. A lock-out device for preventing use of an electrical appliance having a power cord with an electrical plug at the end thereof, said device comprising:

a housing having an open end for relatively close sliding reception of the appliance plug, said housing having at least one opening formed in a side wall thereof near the open end of said housing; and lock means including a padlock having a shackle for locked reception through said housing opening subsequent to reception of the appliance plug into said housing therein, said shackle obstructing removal of the plug from said housing.

* * * * *